US006122791A

United States Patent [19]

Baugh et al.

[11] Patent Number: 6,122,791

[45] Date of Patent: Sep. 26, 2000

[54] RETRIEVABLE PIG

[76] Inventors: Benton F. Baugh, 14626 Oak Bend, Houston, Tex. 77079-6441; Jim Bob Crawford, 108 Coperwood Crossing, Lafayette, La. 70508

[21] Appl. No.: 09/241,194

[22] Filed: Feb. 1, 1999

[51] Int. Cl.[7] ..... B08B 9/02

[52] U.S. Cl. ..... 15/104.061

[58] Field of Search ..... 15/104.05, 104.061, 15/104.062, 104.16, 104.31

[56] References Cited

U.S. PATENT DOCUMENTS

| | | | |
|---|---|---|---|
| 3,052,302 | 9/1962 | Lagucki | 15/104.061 |
| 3,857,132 | 12/1974 | Knapp et al. | 15/104.061 |
| 5,950,271 | 9/1999 | Boyer | 15/104.05 |

FOREIGN PATENT DOCUMENTS

| | | | |
|---|---|---|---|
| 820926 | 4/1981 | U.S.S.R. | 15/104.061 |

OTHER PUBLICATIONS

"Volume of the Composite Catalog of Oilfield Equipment and Services", p. 3352, 1992.

"Pipeline & Gas magazine", 1999.

*Primary Examiner*—Terrence R. Till

[57] ABSTRACT

A pig for pumping thru pipelines for the cleaning of the pipelines which provides for fishing neck type profiles for remote attachment and removal in case of pipeline blockages, provides for the fishing neck type profiles to include valving which will allow communication between the ends of the pig to prevent hydraulic locking in the high pressure ambient condition of subsea pipelines, and provides for interconnection and operation of valving on each end of the pig.

10 Claims, 3 Drawing Sheets

RETRIEVABLE PIG

BACKGROUND OF THE INVENTION

The field of this invention is that of tools used for the cleaning of pipelines, especially the long extended reach pipelines in offshore areas. As hot production crude is produced from the reservoirs below the ocean floor up to the wellhead equipment at the ocean floor and then thru pipelines along the ocean floor, it is cooled by the relatively cool temperature of the ocean water. In deepwater, the temperature can be as cold as 35 degrees Fahrenheit.

A characteristic common to a majority of the oil produced is that there is a paraffin component to the oil which will deposit on the walls of the pipeline and become a solid at temperatures well above the 35 degrees Fahrenheit. In fact, some of the paraffins become a solid at temperatures above 100 degrees Fahrenheit, and so can be deposited or plated on the internal diameters of the pipelines at any expected ambient temperature. The process is similar to discussions of blocking of the arteries of a human being, with a thicker coating building up with time. Some pipelines have become so plugged that more than 90% of the flow area is blocked with the waxes or paraffins.

Typically, as the wall becomes layered with paraffin as the temperature of the oil goes below the solidification temperature of the particular paraffins in the produced fluids. The paraffins act as a sort of insulation to the flow in the pipeline, allowing it to maintain a higher temperature for a greater distance. The effect of this is to extend the distance along the pipeline to which the paraffin is plating onto the internal diameter of the pipeline.

A common cure for this paraffin plating out on the internal diameter of the pipeline is to insert a pig into the flow stream and let the pig remove some of the paraffin. A pig is typically a cylindrical or spherical tool which will brush against the internal diameter of the pipeline in hopes of removing the deposited paraffins. In pipelines with a high incidence of deposited paraffins, a regular maintenance of pigs is normally prescribed as a preventative to pipeline blockage.

One problem with the pigs is that the deposited paraffins are relatively soft and contain a lot of oil. To some extent, the pigs actually compress the paraffins against the wall and squeeze the oil out, leaving a harder and stronger paraffin remaining.

A second problem is that when the paraffin layer on the internal diameter of the pipe is too thick, sloughing off may occur. If the paraffin starts to separate from the wall and continues, the pig begins to literally plow a block of paraffin ahead of itself. This will continue driving more and more paraffin off the wall of the pipeline until the pressure of the pipeline will no longer be able to move the mass. At that time you have a full pipeline blockage, which cannot be moved by pressure from either end.

At that time the plug of paraffin must be removed by chemicals. If access to the downstream end of the plug is available, the chemicals can be delivered from that end. As the paraffin blockage is downstream of the pig, the chemicals cannot be deployed to the plug from the upstream end of the pipeline. If the access is only available from the upstream end, there is no way to remove the pig and allow such delivery.

Another problem is that if the pig were to be grasped to be pulled back toward the upstream end, its tendency to seal against the wall would cause hydraulic locking and make the pig difficult to remove. At the surface we are accustomed to pulling a vacuum of 14.7 p.s.i. which would give a 739 lb. force in an eight inch internal diameter of pipeline. In a pipeline in 1000 foot of depth, the ambient pressure is 465 p.s.i. instead of 14.7 p.s.i., yielding a 23,373 lb. force to overcome instead. The "vacuum locking" in ocean depths can generate massively high forces to overcome.

SUMMARY OF THE INVENTION

The object of this invention is to provide a pig which can be removed from a position in a pipeline adjacent to a paraffin blockage.

A second object of the present invention is a pig with fishing profiles on the ends of the pig to facilitate the pig's removal from the pipeline.

A third object of the present invention is to provide a pig which allows for circulation between ends of the pig and prevents hydraulic locking of the pig in place. Another object of the present invention is to provide automatic operation of valving on the opposite end of the pig when the valving on the near end of the pig is operated.

DESCRIPTION OF THE PREFERRED EMBODIMENT

Figure 1:
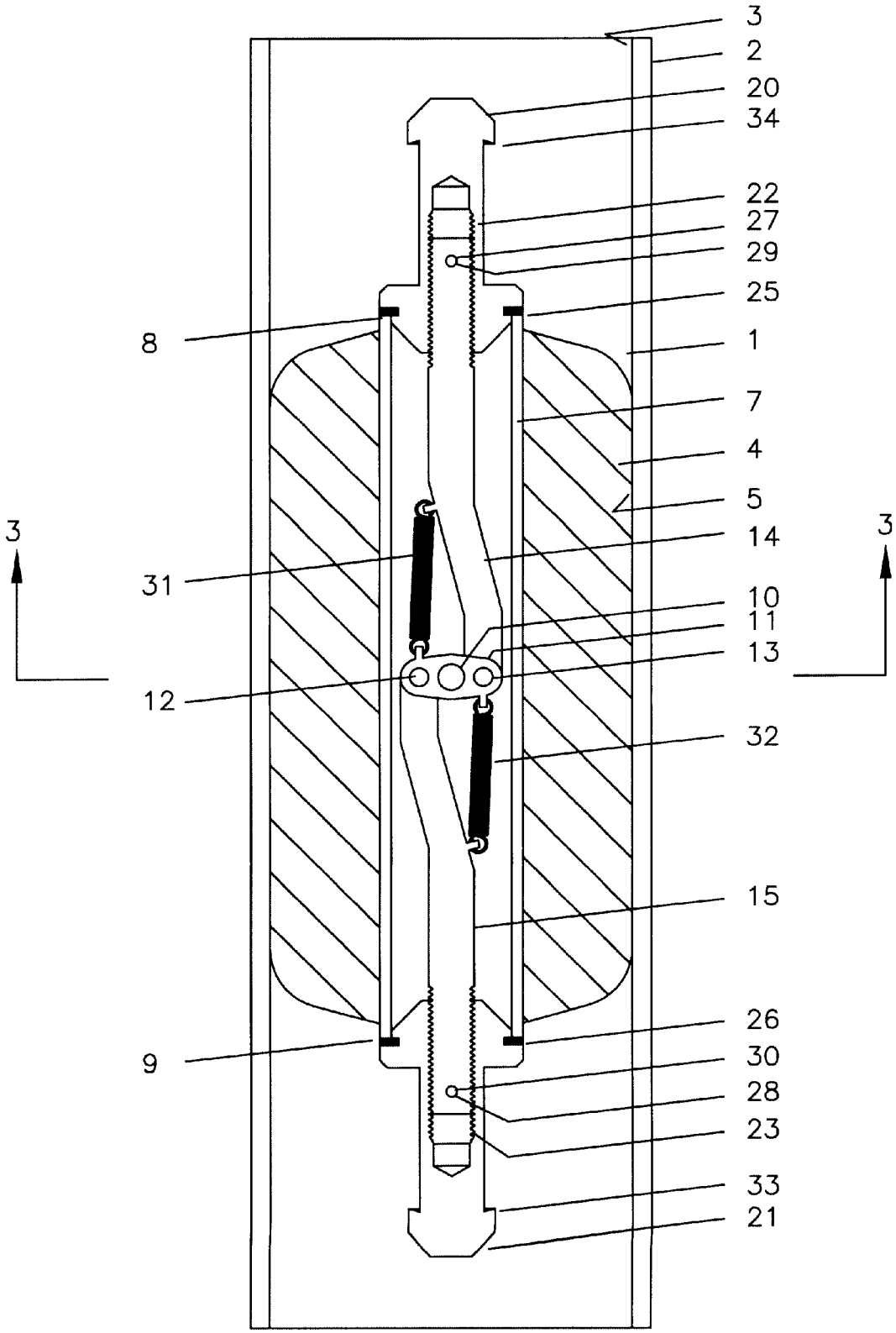
FIG. 1 is a section thru a pig of this invention in the running position.

Referring now to FIG. 1, the pig 1 is in a pipeline 2 with an internal diameter 3. The pig 1 has an outer section 4 which is in contact with the internal diameter 3 of the pipeline 2 at portion 5 and has a portion 6 which is bonded to the insert tube 7. Insert tube 7 has a flat seal area 8 and 9 at each end and a mounting (61 & 62 in FIG. 3) for an axel 10. Swivel plate 11 is mounted about axle 10 and has axles 12 and 13 which engage arms 14 and 15.

End caps 20 and 21 engage threads 22 and 23 which allow adjustment until the seals 25 and 26 engage flat seal areas 8 and 9. When contact is made on both ends, holes 27 and 28 are drilled thru end caps 20 and 21 and arms 14 and 15 for insertion of pins 29 and 30 to secure those positions. Springs 31 and 32 are tensioned by this process to keep the seals 25 and 26 in contact with flat seal areas 8 and 9 respectively. Fishing profiles 33 and 34 are provided for engagement by a fishing tool for recovery. Tools of this type are commonly used in recovery of downhole tools, such as the one shown on page 3352 of the 1992–1993 Volume of the Composite Catalog of Oilfield Equipment and Services as a Combination Sleeve-Type Sucker Rod Socket.

When pressured from either end, the seals engaging the sealing surfaces will render this pig to act as any other cylindrical pig in that it will provide no fluid bypass.

Figure 2:
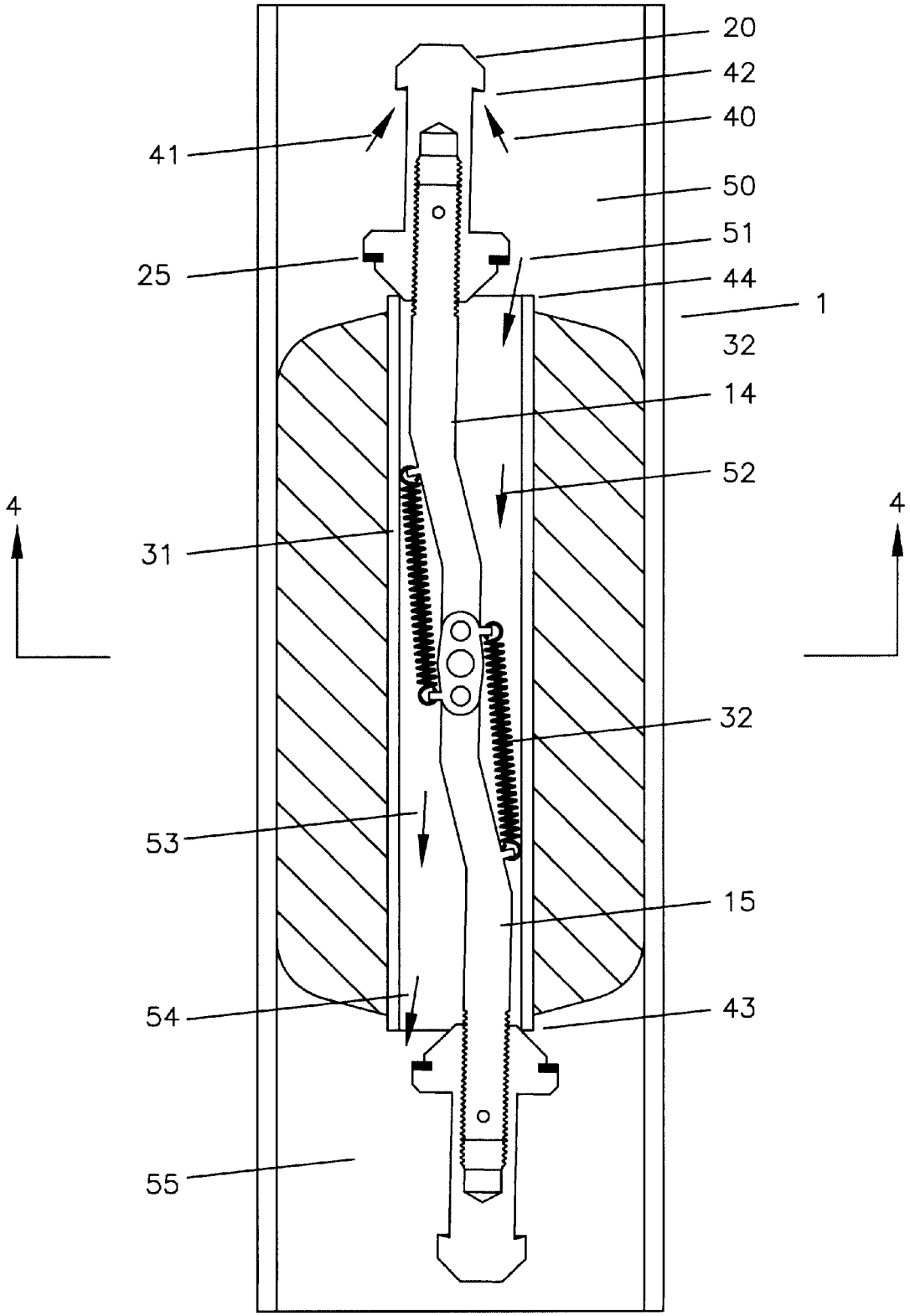
FIG. 2 is a section thru a pig of this invention in the recovery position.

Referring now to FIG. 2, the arrows 40 and 41 indicate how a common fishing tool would engage the circular shoulder 42 to pull the pig to the left in the general direction of the arrows. The force of the arrows 40 and 41 would first attempt to move the pig 1, and if it met with any resistive forces, it would begin to pull the end cap 20 with its seal 25 away from the end 44 of the insert tube 7. Resultant rotary movement of the swivel plate 11 would also provide a movement to the arm 15, pushing the end cap 21 and its seal 26 away from the opposite end 43 of the insert tube 7. Springs 31 and 32 have become elongated during this movement. The result of this is that both ends of the insert tube 7 have been opened, allow full and free flow thru the pig 1. The pig 1 is now ready to be recovered by continued pulling along the general direction of the arrows 40 and 41. During this recovery, fluid will pass from the area in front of the pig 50, along arrows 51–54 to the area behind the pig 55.

Figure 3:
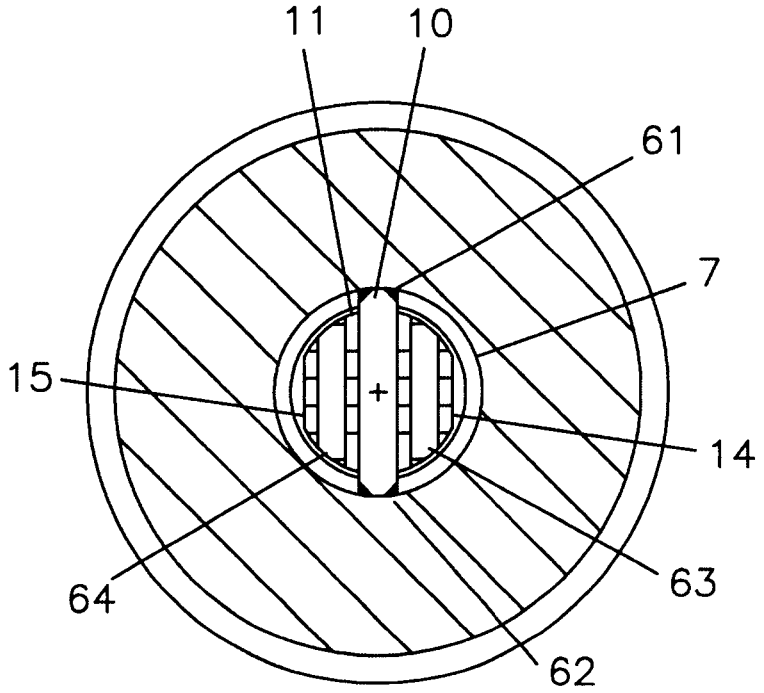
FIG. 3 is a cross section thru FIG. 1 taken along lines "3—3" showing the swivel plate mechanism.

Referring now to FIG. 3, the axle 10 thru the swivel plate 11 is shown welded into the insert tube 7 at 61 and 62. Axles 63 and 64 are shown connecting the swivel plate 11 to the arms 14 and 15.

Figure 4:
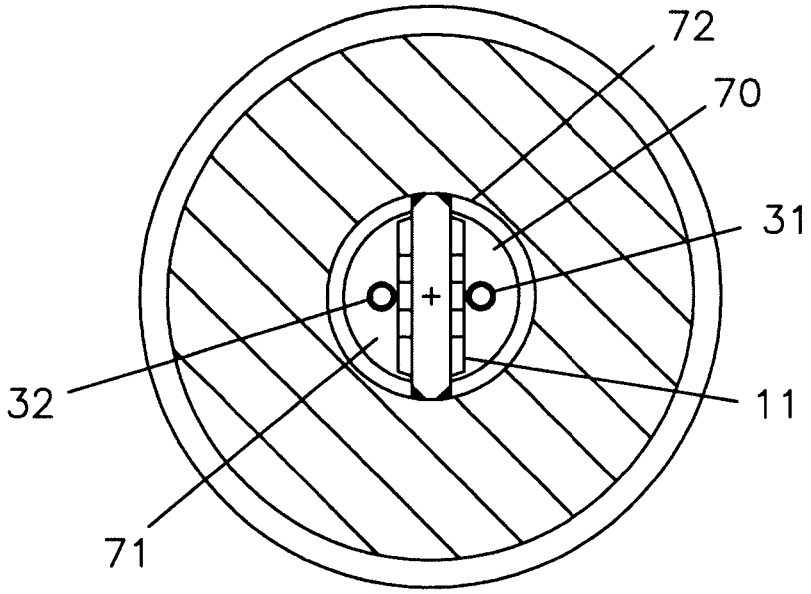
FIG. 4 is a cross section thru FIG. 2 taken along lines "4—4" showing the circulation areas thru the insert when being retrieved.

Referring now to FIG. 4, the swivel plate 11 is now showen laid down as in FIG. 2 providing flow areas 70 and 71 thru the internal bore of the insert tube 11 and around the springs 31 and 32.

The outer surface 72 of the insert tube 7 can be provided with serrations or threading to increase its surface areas to enhance the effectiveness of the bonding of the outer section 4 to the insert tube 7. It is anticipated that the insert tube can be reused when the outer section 4 is worn by remolding a new outer section onto the insert tube and replacing the seals 25 and 26.

The embodiment shown illustrates a separate valve at each end of the insert tube 7 which allows the pig to be used bi-directionally and then recovered from either end. It can be readily seen that if the pig is anticipated to be used only in a single direction and to be recovered in that direction, that only one of the end caps or valve means is necessary.

Additionally, the valves on each end of the pig can be completely independent, with each having individual spring loadings. In that case the fishing tool would open the one on the end to be pulled from, and the opposite end would be opened due to a pressure differential. In this case a reliable spring force would likely generate at least 5 p.s.i. differential or a force of 250 lbs. on an 8" I.D. pipeline.

The fishing profile as illustrated on the figures is an external type in that the gripping shoulder is on the outer portion. This style is lighter, less expensive, and less likely to become plugged than using the reversed embodiment with a male fishing tool and a female profile on the pig, however, either style may be advantageous in different scenarios.

The foregoing disclosure and description of this invention are illustrative and explanatory thereof, and various changes in the size, shape, and materials as well as the details of the illustrated construction may be made without departing from the spirit of the invention.

What is claimed is:

1. A retrievable pig for cleaning a pipeline comprising an insert tube having a first end and a second end, an outer portion external to said insert tube for sliding near or against the inner wall of said pipeline for cleaning said inner wall of said pipeline, a first valve means on said first end having a fishing profile which is opened when a fishing tool pulls on said first fishing profile a second valve means on said second end is opened when said fishing tool pulls on said first fishing profile on said first end wherein said second valve means is mechanically linked to said first valve means, such mechanical link causing the opening movement of said first valve to be transferred to said second valve as an opening movement.

2. The invention of claim 1, such that said opening movement of said first valve and said second valve establishes fluid communication between the upstream end of said pig and the downstream end of said pig.

3. A retrievable pig for cleaning a pipeline comprising an insert tube having a first end and a second end, an outer portion external to said insert tube for sliding near or against the inner wall of said pipeline for cleaning said inner wall of said pipeline, a first valve means on said first end having a fishing profile which is opened when a fishing tool pulls on said first fishing profile, a second valve means on said second end is opened when said fishing tool pulls on said first fishing profile on said first end wherein said first valve means and said second valve means are independently adjustable with respect to their contact with respective sealing surfaces.

4. A retrievable pig for cleaning a pipeline comprising an insert tube having a first end and a second end, an outer portion external to said insert tube for sliding near or against the inner wall of said pipeline for cleaning said inner wall of said pipeline, a first valve means on said first end having a fishing profile which is opened when a fishing tool pulls on said first fishing profile, a second valve means on said second end is opened when said fishing tool pulls on said first fishing profile on said first end wherein said second valve means has a fishing profile which can be engaged by a fishing tool and will be opened when said fishing tool pulls on said fishing profile.

5. The invention of claim 4, wherein said first valve means is mechanically linked to said second valve means, such mechanical link causing said opening movement of said secoro valve to be transferred to sad first valve as an opening movement.

6. The invention of claim 5, wherein said opening movement of said first valve and said second valve establishes fluid communication between said upstream end of said pig and said downstream end of said pig.

7. The invention of claim 6, wherein upon the release of said pull on said fishing profile, said fluid communication between said upstream end of said pig and said downstream end of said pig will be blocked.

8. A retrievable pig for cleaning a pipeline comprising an outer portion for sliding near or against the inner wall of said pipeline, one or more fishing profiles on one or more ends of said pig for engagement by a fishing tool for the recovery of said pig from said pipeline wherein pulling on one of said fishing profiles will allow circulation between the upstream end of said pig and the downstream end of said pig.

9. The invention of claim 8, wherein said release of said pulling on said fishing profile will cause said circulation between said upstream end of said pig and said downstream end of said pig to be blocked.

10. The invention of claim 8, wherein said release of said pulling on said fishing profile will not cause said circulation between said upstream end of said pig and said down stream end of said pig to be blocked.

* * * * *